United States Patent [19]

Winchell

[11] 4,160,473

[45] Jul. 10, 1979

[54] PLASTIC CONTAINER WITH AUXILIARY TUBE RETENTION MEANS

[75] Inventor: David A. Winchell, Twin Lakes, Wis.

[73] Assignee: Baxter Travenol Laboratories, Inc., Deerfield, Ill.

[21] Appl. No.: 907,367

[22] Filed: May 19, 1978

[51] Int. Cl.[2] ..... B65D 1/00

[52] U.S. Cl. ..... 150/0.5; 128/227; 128/214 D; 128/272

[58] Field of Search ..... 128/DIG. 24, 214 D, 128/227, 272; 150/1, 8, 0.5; 206/438, 570, 571, 572

[56] References Cited

U.S. PATENT DOCUMENTS

| | | | |
|---|---|---|---|
| 1,955,008 | 4/1934 | McGee | 128/227 |
| 2,087,780 | 7/1937 | Powell | 128/227 |
| 2,896,619 | 7/1959 | Bellamy | 128/214 D |
| 3,079,920 | 3/1963 | Bellamy | 128/272 |
| 3,211,144 | 10/1965 | Nehring | 128/272 X |
| 3,726,276 | 4/1973 | Schumann | 128/DIG. 24 |

*Primary Examiner*—Donald F. Norton

*Attorney, Agent, or Firm*—Paul C. Flattery; John P. Kirby, Jr.; Garrettson Ellis

[57] ABSTRACT

A plastic container such as a collapsible blood bag or a parenteral solution container may include a flexible sheet member integrally attached to a plastic container and defining lines of tearing weakness for defining and unfolding an elongated sheet member portion, which, in turn, defines a second line of tearing weakness for forming a retaining aperture for receiving a sample tube and the like. Also, the container may have a retention member positioned at each end of the plastic container comprising open, transverse channel means proportioned to receive a length of flexible tubing wound about the ends of said container.

14 Claims, 5 Drawing Figures

PLASTIC CONTAINER WITH AUXILIARY TUBE RETENTION MEANS

BACKGROUND OF THE INVENTION

Blood and parenteral solutions are commonly stored in flexible, collapsible bags so that they may be dispensed in a sterile manner without the necessity of introducing air into the container interior.

Particularly in the case of blood bags, it is desirable to provide a means for the retention of sample tubes in physically attached relation to the blood bag, to facilitate blood typing operations and to avoid the accidental switching of sample tubes or mislaying them. The common retention means which has been used is as disclosed in U.S. Pat. No. 3,079,920, comprising slit members in a peripheral flange on the blood bag. The sealed donor tubing and/or rigid sample tubes may be used as the carriers of blood samples.

In blow molded, collapsible containers for parenteral solutions, blood, and the like, it has been found to be inconvenient to mold on the container a lateral flange having slit members. Such an operation tends to result in an increased number of rejects, and requires complex molds and an increased cost.

Accordingly, the invention of this application provides integral means for carrying sample tubes of either the rigid type, or flexible donor tubing, on a plastic bag. As particular advantages, the sample tube carrying means of this invention are highly compatible with blow molding, and in general provide improved convenience of use in attaching and detaching sample tubes from a plastic container.

DESCRIPTION OF THE INVENTION

In accordance with this invention, a plastic container is provided in which a flexible sheet member is integrally attached at the edge thereof to the plastic container. The sheet member defines a first line of tearing weakness which extends from a free edge of the sheet member inwardly thereof, to terminate at a point of the sheet member which is spaced from its edges. Accordingly, tearing of the first line of weakness permits the defining and unfolding of at least one elongated sheet member portion. The elongated sheet member portion defines a second line of tearing weakness, both ends of which are spaced from the edges of the sheet member portion, whereby the second line may be torn open to define a retaining aperture for receiving a sample tube and the like.

Also, in accordance with this invention, a plastic container may be provided defining sealed, closed ends in which retention member means are positioned at each end of the plastic container. The retention member means are integrally attached to the container, and comprise open, transverse channel means proportioned to receive a length of flexible tubing wound about the ends of the container. This flexible tubing is typically contemplated to be the donor tubing of a blood bag.

The plastic container itself preferably defines flexible, collapsible walls in the manner of a conventional blood bag or collapsible solution container, with sealed access port means positioned at one end thereof.

The flexible sheet member which may be attached to the container of this invention preferably has a first line of tearing weakness which defines a tortuous path, whereby tearing of the first line permits the defining and unfolding of a pair of elongated sheet member portions.

Each of the pair of elongated sheet member portions may define a second line of tearing weakness, both ends of which are spaced from the edges of the respective sheet member portions. As a result, each second line may be individually torn open to define a second retaining aperture for receiving a sample tube and the like.

The retention member means positioned at opposed ends of the container each preferably define a plurality of the open transverse channel means so that multiple coils of the flexible tubing such as blood donor tubing may be wound about the ends of the container for convenient storage. This donor tubing may be an integral part of the container, which, in turn, may be a blood bag or the like, or it may be separated prior to winding for purposes of storage.

The retention member means at the opposed ends of the container may be positioned at opposed side on the ends of the container, so that the flexible tubing may be wound about the container ends in diagonal relation to the longitudinal axis of the container.

Figure 1:
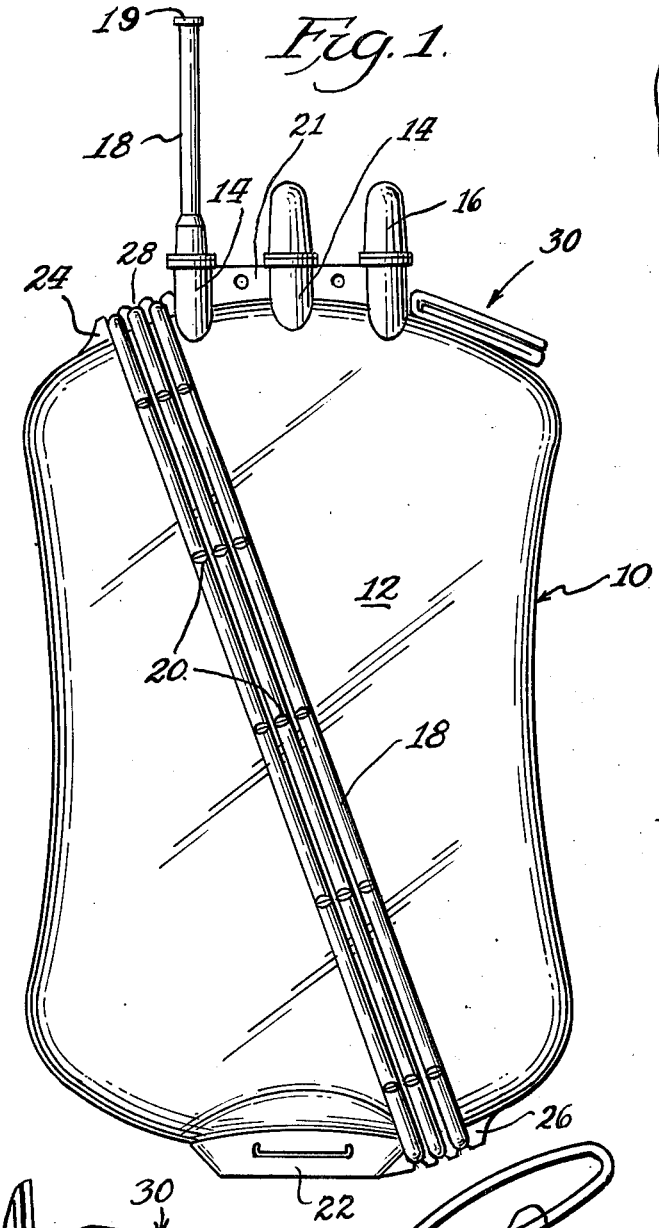
FIG. 1 is an elevational view of the flexible, collapsible blood bag in accordance with one embodiment of this invention.

Referring to the drawings, FIG. 1 shows a blood bag 10 which may be made by blow molding, for example, as disclosed in Winchell, et al. patent application Ser. No. 817,940, filed July 21, 1977. Basically, the entire blood bag is made from tubular parison in a blow mold, having flexible collapsible walls 12, and sealed at is opposite ends. At its head end, a plurality of tubular access ports 14 are provided, two of which are shown to be sealed with closures 16, and a third of which carries conventional donor tubing 18 for a blood bag. In the particular embodiment shown, the donor tubing of the blood bag has been transversely heat sealed in conventional manner, as at seal 19, and has been severed at the proximal seal 19, proximal to the blood bag, with the remainder of the donor tubing 18 being wound about the ends of the blood bag 10, and sealed with transverse heat seals 20.

At the tail end of bag 10, there is formed in integral bag hanger member 22. Both ports 14 and bag hanger 22 are integrally molded out of the tubular parison which forms the flexible wall 12 of bag 10.

Web members 21 are defined between ports 14 as shown.

In accordance with this invention, retention member means 24, 26 are positioned at each end of the plastic container, being also integrally molded from the parison which forms the remaining parts of bag 10. Each retention member 24, 26 which may be identically designed, defines preferably a plurality of open transverse channel means 28 extending across the narrowest dimension of bag 10 to provide a site for retaining and receiving the wound donor tubing 18 in a convenient manner for storage of the tubing. While the specific embodiment shows the majority of the length of donor tubing 18 to be severed from the bag 10, it is also contemplated that the donor tubing can be wound on the bag without being severed, for storage of the whole, unattached donor tubing 18. Likewise, the donor tubing is shown to be heat sealed into discreet lengths, as is done after collection of blood to provide plurality of small blood samples, but the tubing may also be stored in its wound configuration on retention members 24, 26 without the transverse heat seals 20 if desired.

Figure 3:
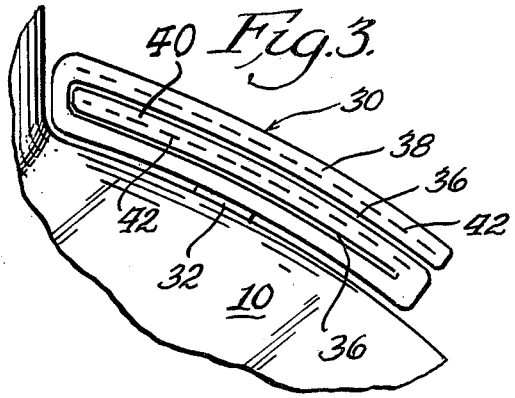
FIG. 3 is a greatly enlarged, detailed view of the flexible sheet member in its original position as shown in FIG. 1.

Referring to FIG. 3, blood bag 10 as shown here may also define a flexible sheet member 30, which is attached to the remainder of the container at an edge 32 and may be integral with the container, being formed at the time of blow molding out of the initial parison along with the rest of the parts of bag 10. The integral edge 32, which connects sheet 30 to bag 10, may constitute less than half and preferably less than one quarter of the entire facing edges of the sheet 30 and bag 10, to provide a flexible joint between the two members 10, 30 for ease of manipulation of the unfolded sheet member.

Sheet member 30 defines a first line of tearing weakness 36, which is shown to define a tortuous path to permit the defining and unfolding of a pair of elongated sheet member portions 38, 40 as the line of tearing weakness 36 is torn open. The open configuration of member 30 is as shown in FIG. 4.

Figure 4:
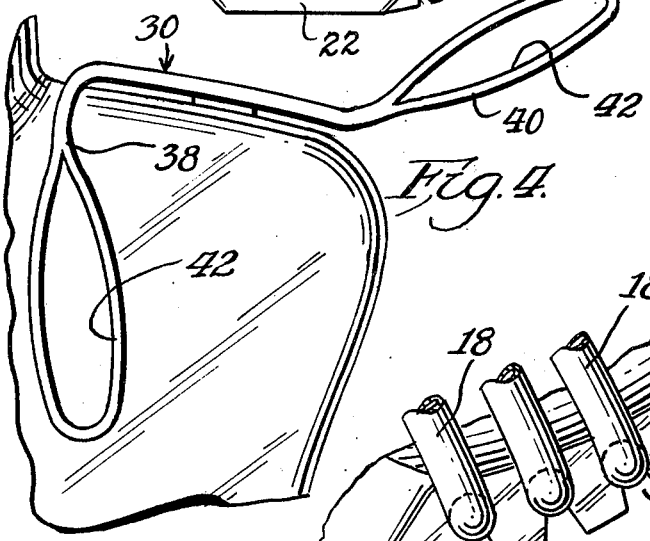
FIG. 4 is a greatly enlarged, elevational view of the sheet member of FIG. 3 in its unfolded configuration.
Figure 5:
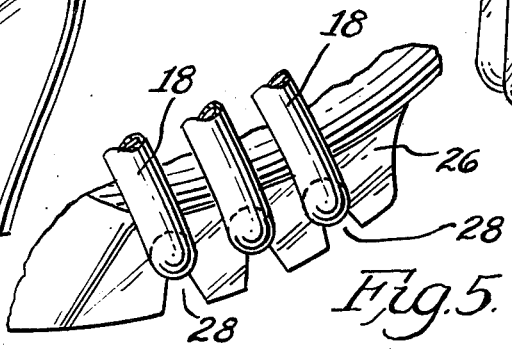
FIG. 5 is a greatly enlarged, fragmentary elevational view of the lower retention member means of the bag of FIG. 1 showing the open transverse channel means and flexible tubing wound in them.

Also, each of the sheet member portions 38, 40 define a second line of tearing weakness 42, both ends of which, as well as the central portion thereof, are spaced from the edges of the respective sheet member portions that they occupy, so that each second line of tearing weakness 42 may be individually torn open, as shown in FIG. 4, to define a retaining aperture for receiving a sample tube and the like.

Figure 2:
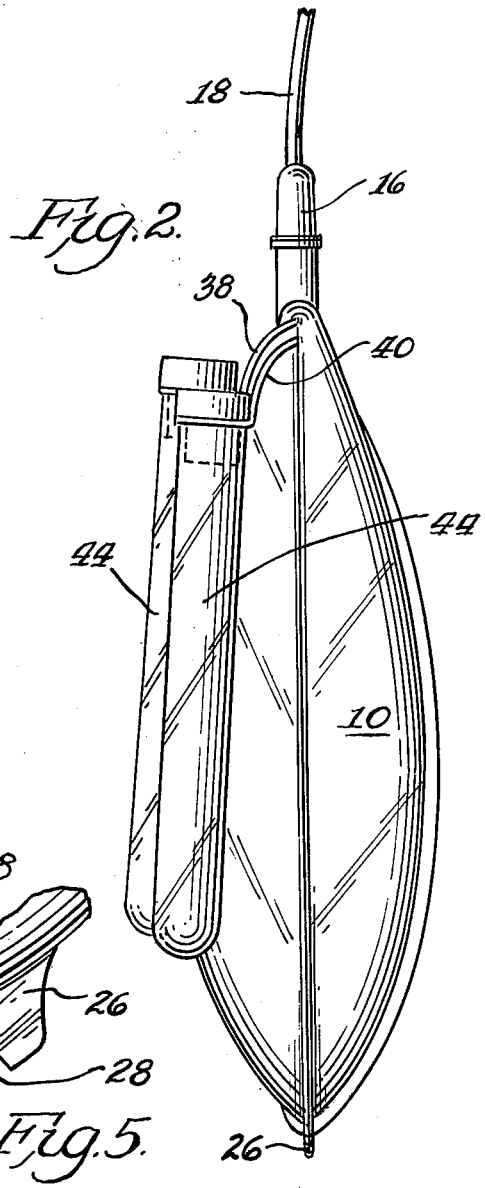
FIG. 2 is an elevational view of the blood bag of FIG. 1, rotated 90° about its longitudinal axis and carrying a pair of rigid sample tubes by means of the flexible sheet member, with the wound tubing omitted.

Thereafter, sample tubes 44 may, as desired, be inserted into the apertures defined by the tearing of lines of weakness 42, and hung on bag 10 as shown in FIG. 2.

Accordingly, for use, sheet member 30 is spread open by tearing of the lines of weakness 36 and 42, from its initial configuration as shown in FIG. 3 to the configuration of FIG. 4, after which sample tubes may be placed through the apertures defined by open lines 42 as shown in FIG. 2. Preferably, the length of lines 42 are selected to be slightly less than one-half of the circumference of the sample tubes 44 which they are intended to carry, so that they may be carried with a resilient, slightly stretched grip within the apertures formed by the severing of lines 42.

As shown in FIG. 1, the retention member means 24, 26 at the opposed ends of bag 10 may be positioned at opposed sides on the ends of the bag, so that the flexible tubing 18 may be wound about the container end in diagonal relation to the longitudinal axis of the container.

The above has been offered for illustrative purposes only, and is not intended to limit the scope of the invention of this application, which is as defined in the claims below.

That which is claimed is:

1. In a plastic container, the improvement comprising:

a flexible sheet member integrally attached at an edge thereof to said plastic container, said sheet member defining a first line of tearing weakness which extends from a free edge of the sheet member inwardly thereof to terminate at a point of said sheet member which is spaced from the edges thereof, whereby tearing of said first line permits the defining and unfolding of at least one elongated sheet member portion, said elongated sheet member portion defining a second line of tearing weakness, both ends of which are spaced from the edges of said sheet member portion, whereby said second line may be torn open to define a retaining aperture for receiving a sample tube and the like.

2. The plastic container of claim 1 which has flexible, collapsible walls with sealed access port means positioned at one end thereof.

3. The plastic container of claim 2 which is blow molded from a tubular parison.

4. The plastic container of claim 3 in which said first line of tearing weakness defines a tortuous path, whereby tearing of said first line permits the defining and unfolding of a pair of elongated sheet member portions, each of said pair of elongated sheet member portions defining a second line of tearing weakness both ends of which are spaced from the edges of respective sheet member portions, whereby each second line may be individually torn open to define a retaining aperture for receiving a sample tube and the like.

5. The plastic container of claim 4 defining sealed, opposed ends, and including retention member means positioned at each end of the plastic container, said retention member means being integrally attached to said container and comprising open transverse channel means proportioned to receive a length of flexible tubing wound about the ends of said container.

6. The plastic container of claim 5 in which the retention member means at each end of said container each defines a plurality of open transverse channel means to permit the winding of multiple coils of said flexible tubing about the ends of said container.

7. The plastic container of claim 6 which carries a length of flexible tubing wound about the ends of said container and occupying the open transverse channel means of said container.

8. In a plastic container defining sealed, opposed ends, one of said ends carrying access port means, the improvement comprising:

retention member means positioned at the edge of each end of said plastic container, said retention member means being integrally attached to said container and comprising open transverse grooves proportioned to receive a length of flexible tubing wound about the ends of said container.

9. The plastic container of claim 8 in which the retention member means at each end of said container each defines a plurality of open transverse grooves to permit the winding of multiple coils of said flexible tubing about the ends of said container.

10. The plastic container of claim 9 which carries a length of flexible tubing wound about the ends of said container and occupying the open transverse channel means of said container.

11. The plastic containier of claim 8 which is blow molded from a tubular parison.

12. The plastic container of claim 11 which defines flexible, collapsible walls and defines access port means at one end thereof.

13. The plastic container of claim 12 in which said retention member means comprise an integral part of the container and are molded from said parison during the blow molding of said container.

14. The plastic container of claim 13 in which said retention member means at the opposed ends thereof are also positioned at opposed sides on said ends of the container whereby said flexible tubing may be wound about the container ends in diagonal relation to the longitudinal axis of said container.

* * * * *